United States Patent [19]

Marracino

[11] Patent Number: 4,624,123

[45] Date of Patent: Nov. 25, 1986

[54] STRAIGHTENING MACHINE FOR MOTOR ARMATURE ASSEMBLIES AND THE LIKE

[75] Inventor: Nicholas J. Marracino, Torrington, Conn.

[73] Assignee: Bertolette Machines, Inc., Torrington, Conn.

[21] Appl. No.: 794,754

[22] Filed: Nov. 4, 1985

Related U.S. Application Data

[63] Continuation-in-part of Ser. No. 731,754, May 7, 1985, abandoned, which is a continuation of Ser. No. 537,797, Sep. 30, 1983, abandoned.

[51] Int. Cl.[4] ..... B21D 3/16

[52] U.S. Cl. ..... 72/110; 72/431

[58] Field of Search ..... 72/35, 110, 418, 431

[56] References Cited

U.S. PATENT DOCUMENTS

| | | | |
|---|---|---|---|
| 503,616 | 8/1893 | Peacock | 72/110 |
| 2,724,421 | 11/1955 | Brannen | 72/110 |
| 3,464,253 | 9/1969 | Beyer et al. | 72/110 |
| 3,583,191 | 6/1971 | Colonius et al. | 72/110 |

FOREIGN PATENT DOCUMENTS

| | | | |
|---|---|---|---|
| 29709 | 9/1973 | Japan | 72/110 |

*Primary Examiner*—Lowell A. Larson

*Attorney, Agent, or Firm*—McCormick, Paulding & Huber

[57] ABSTRACT

A machine for straightening cylindrical workpieces such as motor armature assemblies having diametrically enlarged intermediate sections and reduced diameter opposite end sections coaxial with the intermediate sections. The machine has first and second separable bearing units aligned axially and spaced apart axially for engagement and support of said reduced diameter opposite end sections of a workpiece. In one embodiment, at least one end section projects axially and with the workpiece rotating, a radially movable deflection device engages the projecting end section of the workpiece, bends and slowly returns the same to axial alignment. In a second embodiment, both end sections of the shaft or reduced diameter portion are deflected and straightened simultaneously. In a third embodiment the intermediate section is bent out of axial alignment and slowly returned for straightening relative to the opposite end sections.

19 Claims, 9 Drawing Figures

STRAIGHTENING MACHINE FOR MOTOR ARMATURE ASSEMBLIES AND THE LIKE

CROSS REFERENCE TO RELATED APPLICATIONS

The present application is a continuation-in-part of Ser. No. 06/731,754, filed on May 7, 1985; which in turn is a continuation of Ser. No. 06/537,797, filed on Sept. 30, 1983, both now abandoned.

BACKGROUND OF THE INVENTION

Various types of straightening machines have been provided in the past for a variety of workpieces. It is believed, however, that motor armature assemblies have not enjoyed the benefit of automatic straightening on machines particularly adapted therefor.

Accordingly, it is the general object of the present invention to provide a straightening machine particularly adapted to handle and to straighten efficiently motor armature assemblies and the like in the form of cylindrical workpieces having diametrically enlarged intermediate sections which may comprise a rotor and reduced diameter opposite end sections coaxial with the intermediate section and which may comprise opposite end portions of a unitary shaft or oppositely extending coaxial but discrete shafts associated with the rotor.

SUMMARY OF THE INVENTION

In fulfillment of the foregoing object a machine is provided for straightening cylindrical workpieces having diametrically enlarged intermediate sections and reduced diameter opposite end sections coaxial with the intermediate section. The machine comprises first and second bearing units which are aligned axially and which are spaced apart axially for engagement and support of the reduced diameter opposite end sections of a workpiece in one embodiment with at least one of the end sections projecting axially substantially beyond its associated bearing unit. The bearing units are radially separable for movement between open and closed positions for the radial introduction and retention of the workpiece end sections therein. A power operated rotary drive means is engageable with the diametrically enlarged intermediate section of a workpiece held by the bearing units whereby to rotate the same during a straightening operation. A radially movable deflection device engageable with the projecting end section of the workpiece during rotation thereof serves to bend the same out of axial alignment with the remaining sections of the workpiece and thereafter return the same to a condition of axial alignment at a relatively slow and closely controlled rate of movement. Automatic and highly efficient straightening of the workpieces results.

In a preferred form of the invention, a pair of lower bearing half sections are mounted on a support plate and are movable vertically therewith for selective introduction of workpieces and retention of the same in the bearing units. A pair of spaced apart loading rails extend at a slight downward angle toward the bearing half sections so that a workpiece may be placed thereon and rolled slowly into position in the lower half sections of the bearing units. Thereafter, the support plate is raised to engage the end sections of the workpiece between lower and upper half sections of the bearing units and to engage the diametrically enlarged center section with a rotary drive means. When the workpiece has been rotated and deflected at its projecting end portion in a straightening operation, a discharge member disposed beneath the intermediate section of the workpiece is elevated slightly whereby to lift the workpiece from its lower bearing half sections with the bearings in an open condition, and the workpiece thereafter rolls along the discharge member rearwardly in the machine in a discharge operation.

If so desired, the straightening machine may be readily adapted for a straightening operation on opposite end sections of a workpiece with the said end sections being deflected separately but in unison during rotation of the workpiece.

In a still further embodiment the intermediate workpiece section may be deflected for straightening relative to the end sections.

DESCRIPTION OF THE PREFERRED EMBODIMENTS

Figure 1:
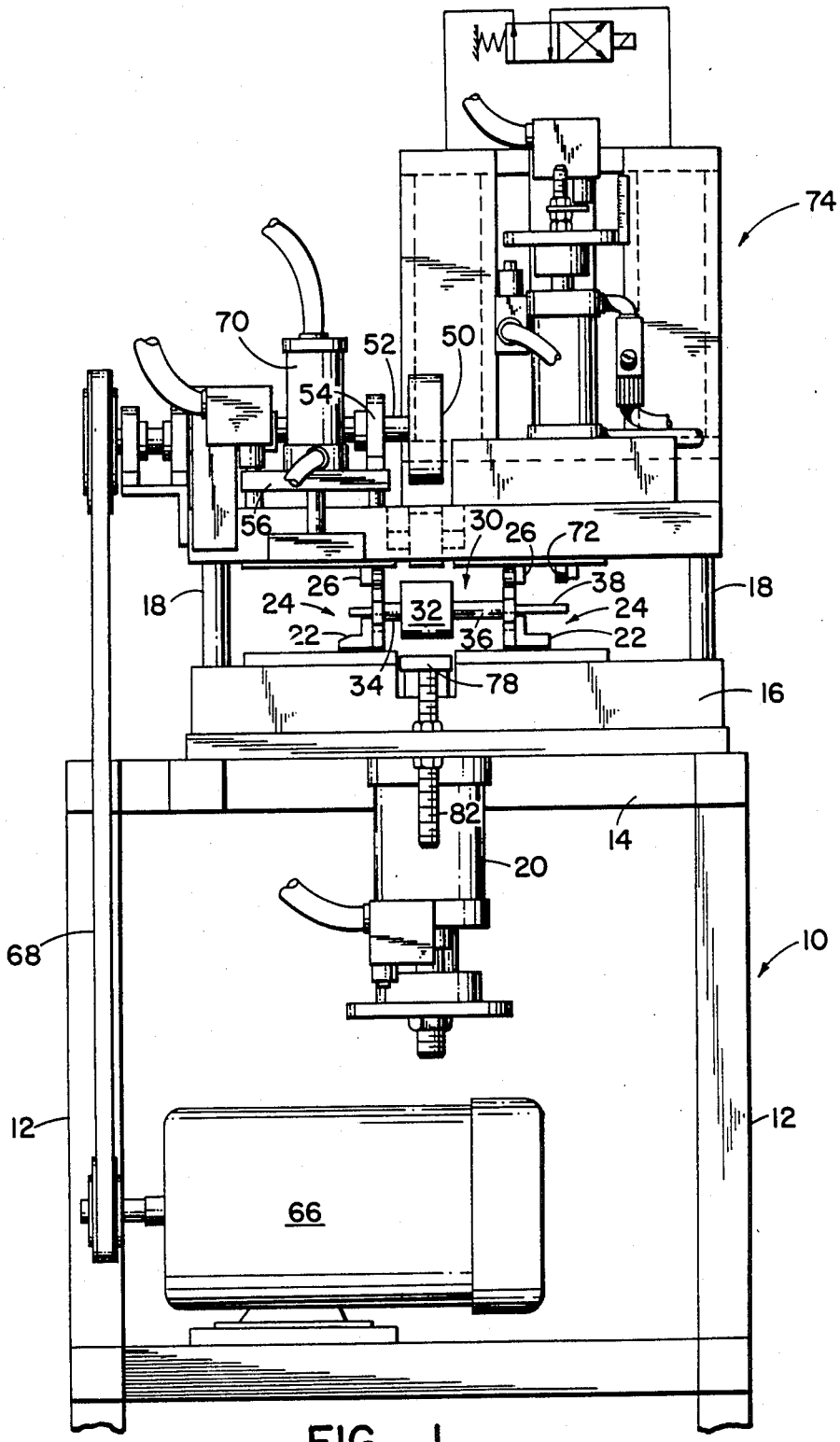
FIG. 1 is a partially schematic front view of a straightening machine constructed in accordance with the present invention.
Figure 2:
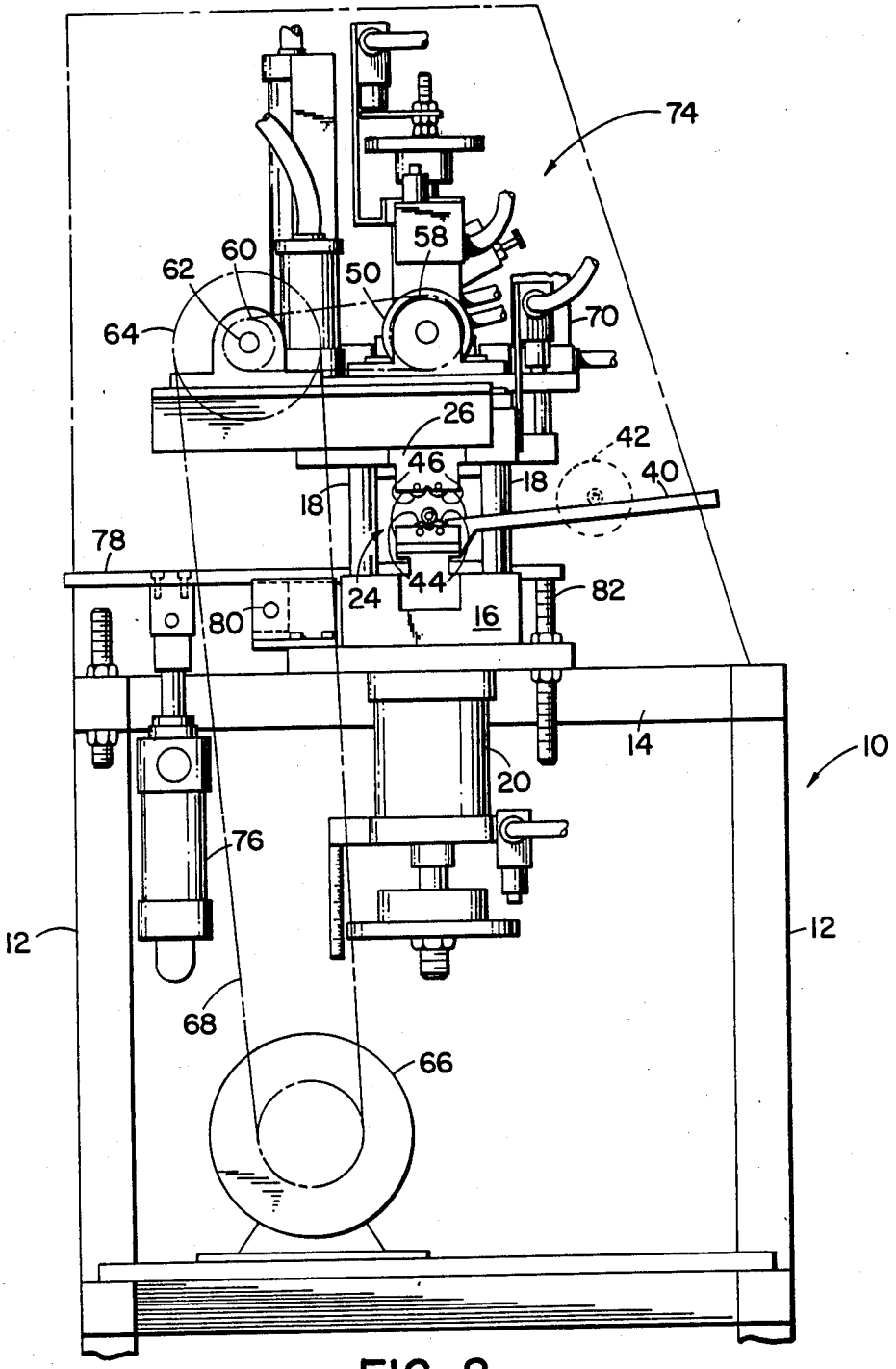
Fig. 2 is a partially schematic lefthand side view of the straightening machine.

Referring particularly to FIGS. 1 and 2, it will be observed that a straightening machine indicated generally at 10 has vertical frame members 12,12 arranged to support a horizontal frame 14 which in turn supports a plate or table 16 movable vertically on four guide members 18,18. The table or horizontal plate 16 is urged upwardly and downwardly as required in the operation of the machine by means of a suitable fluid cylinder 20 therebeneath. Mounted on the plate or table 16 are lower half sections 22,22 of bearing units 24,24 which cooperate with upper half sections 26,26. The bearing units 24,24 are aligned axially and spaced apart axially relative to a workpiece indicated generally at 30.

The workpiece 30 may comprise a motor armature assembly or the like and has a rotor or diametrically enlarged intermediate section 32 with reduced diameter opposite end sections 34,36 coaxial with the intermediate section. As best illustrated in FIG. 1, the workpiece 30 illustrated has an end section or shaft 36 which is substantially longer than the opposite end section or shaft 34 and which has a projecting end portion 38 which extends beyond the righthand bearing unit 24.

Figure 3:
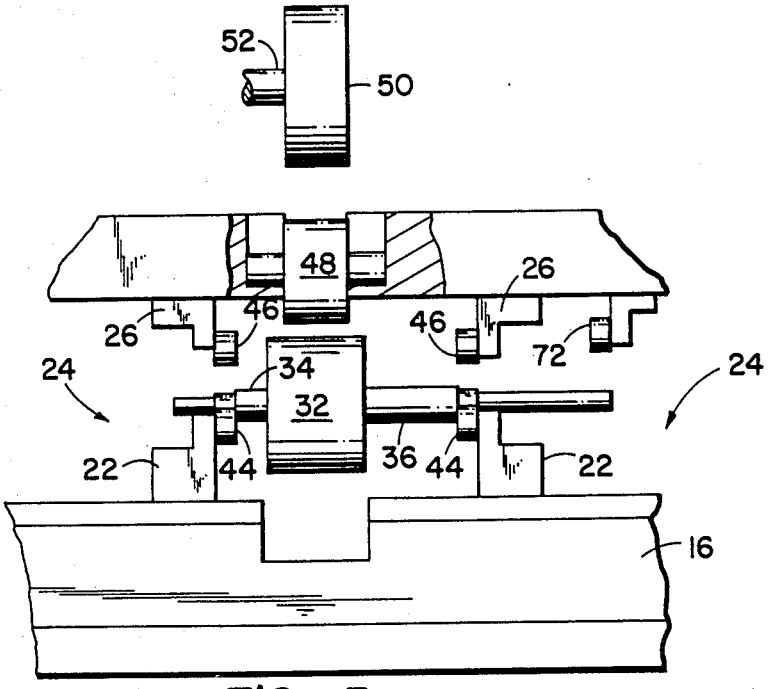
FIG. 3 is a fragmentary enlarged schematic view showing a portion of the straightening machine with a workpiece mounted therein and the machine in a preliminary condition wherein bearing units are open and the workpiece is at rest.

In FIGS. 1 and 3 the workpiece 30 is at rest in the lower half sections 22,22 of the bearing units 24,24. In such position of a workpiece, the cylinder 20 may be operated to cause a table or plate 16 to move upwardly and to urge the workpiece 30 upwardly to the position of FIG. 4.

Figure 4:
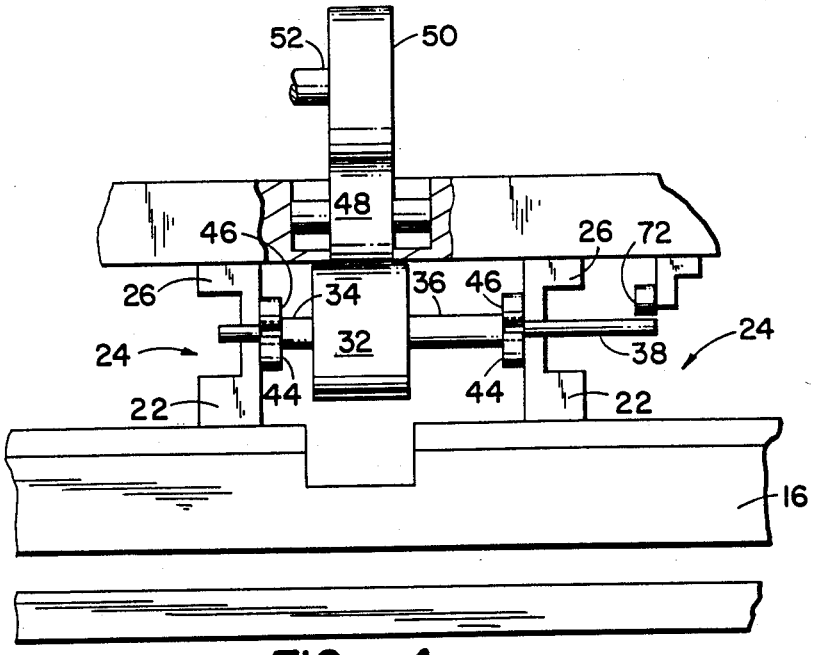
FIG. 4 is an enlarged fragmentary schematic view similar to FIG. 3 but showing the machine with the bearing units in a closed condition, the workpiece engaged with a rotary drive means, and the projecting end section of the workpiece in a straight or axially aligned condition.

Prior to elevation of the workpiece as in FIG. 4, and during a workpiece loading operation, it is preferred that a pair of loading rails 40,40 be employed as best illustrated in FIG. 2, one shown. The single rail 40 shown in FIG. 2 has a counterpart in alignment therewith and therebehind so as to provide for the loading of workpieces on the rails at a front portion of the machine; see broken line 42. The workpieces are then permitted to roll rearwardly and to enter the lower half sections of the bearing units as shown at 30.

As best illustrated in FIG. 2, the lower half sections of the bearing units preferably comprise two small rotor bearings 44,44 mounted on axes parallel to the axis of the workpiece. The rollers are spaced apart slightly so as to form a cradle configuration for receiving and holding the end portion of a workpiece 30. Similarly, the upper bearing half sections may comprise small rollers 46,46 on parallel axes which are also parallel with the axis of the workpiece.

When a workpiece such as 30 has been mounted in the lower bearing units 22,22, the cylinder 20 actuated, and the plate 16 elevated to raise the workpiece to the FIG. 4 position, the workpiece is in a condition of readiness for a straightening operation. It will be observed in FIG. 4 that a rotary drive means is provided in the form of a roller 48. The roller 48 is preferably mounted in vertical slots not shown so as to float upon engagement by a diametrically enlarged intermediate workpiece section or rotor 32. Preferably, the roller 48 is of a rubber-like construction and is driven by a second similar roller 50 disposed thereabove and shown in FIG. 4 in engagement therewith. Reverting to FIGS. 1 and 2, it will be observed that the roller 50 is mounted on a shaft 52 which extends horizontally and is journalled at 54,54 on a plate 56. At an opposite end portion of the shaft 52, a drive belt or pulley 58 is provided for cooperation with a belt or pulley 60 in turn mounted on a shaft 62. The shaft 62 also carries a belt or pulley 64 driven by a electric motor or the like 66 via a belt or pulley 68. Thus, the drive roller 50 can be rotated as required to frictionally drive the roller 48 and in turn to rotate the workpiece 30 therebeneath having its intermediate section or rotor 32 in firm engagement with the drive roll 48. As will be noted, the drive roller 50 is movable upwardly and downwardly with the plate 56 and at the urging of a fluid operable cylinder 70. Thus, the rollers 50 and 48 may be engaged by appropriate downward movement of the plate 56 for selective operation of the drive rolls 48,50 and for rotation of the workpiece 30 as required during a straightening operation.

With the workpiece rotating, the aforementioned projecting end portion thereof may be deflected and thereafter slowly and precisely moved to a position of axial alignment with remaining sections of the workpiece 30 in a straightening operation. Preferably, a deflection device which is movable radially to effect the necessary bending or deflection of the workpiece takes the form of a pair of small rollers, one shown at 72, and which may be substantially identical with the aforementioned rollers 44,44. The rollers 72,72 are spaced apart on parallel axes which are also parallel with the axis of the workpiece 30.

Figure 5:
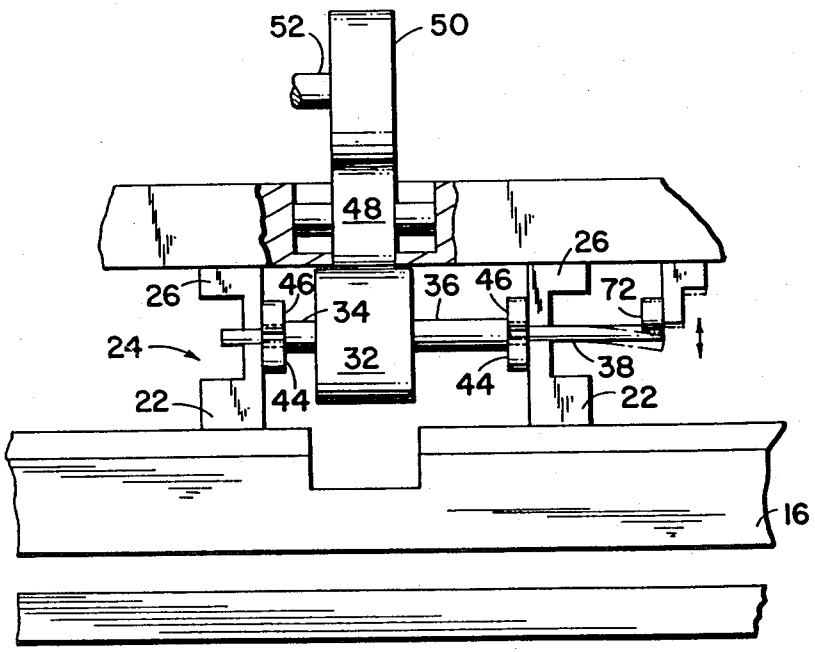
FIG. 5 is an enlarged fragmentary schematic view similar to FIG. 4 but showing the workpiece with its projecting end section deflected from axial alignment in the straightening operation.

A means for urging the roller 72,72 downwardly as required to deflect the workpiece end portion as shown in FIG. 5 may vary within the scope of the invention and may comprise a hydraulic cylinder but is preferably in the form of an air over oil system of a conventional type and which is indicated generally at 74. The air over oil system 74 serves to urge the rollers 72,72 downwardly as required to deflect the projecting end portion of the workpiece as shown in FIG. 5. On the return or upward movement of the rollers 72,72 the movement is precisely controlled by the air over oil system whereby to provide a highly efficient straightening operation.

On completion of the straightening operation, a fluid cylinder 76, FIG. 2, may be operated to actuate a discharge means for removing a workpiece as a new workpiece is introduced along the rails 40,40. The fluid cylinder 76 is operatively connected with a narrow elongated member 78 which extends beneath a central portion of the workpiece and is engageable with the intermediate workpiece section 32 when a rear end portion of the member is pulled downwardly by the cylinder 76 about a pivot pin 80. That is, the intermediate and forward end portions of the member 78 are elevated slightly so as to engage an intermediate section 32 of a workpiece 30 and to raise the same slightly for gravity discharge rearwardly. The member 78 is inclined slightly rearwardly so as to provide for the gravity induced rearward rolling action of the workpiece and discharge thereof at a rear end portion of the member 78. At a front end portion of the member 78 an adjustable stop may be provided as at 82 for various workpieces having rotors or intermediate sections of varying diameter.

Figure 7:
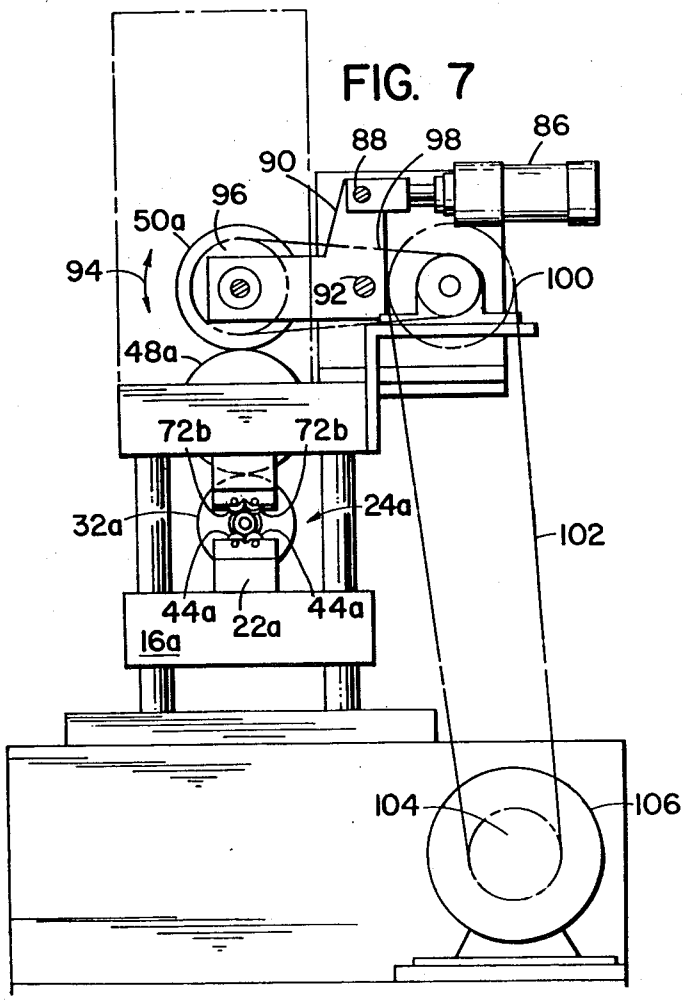
FIG. 7 is a righthand side view of the straightening machine of FIG. 6.
Figure 6:
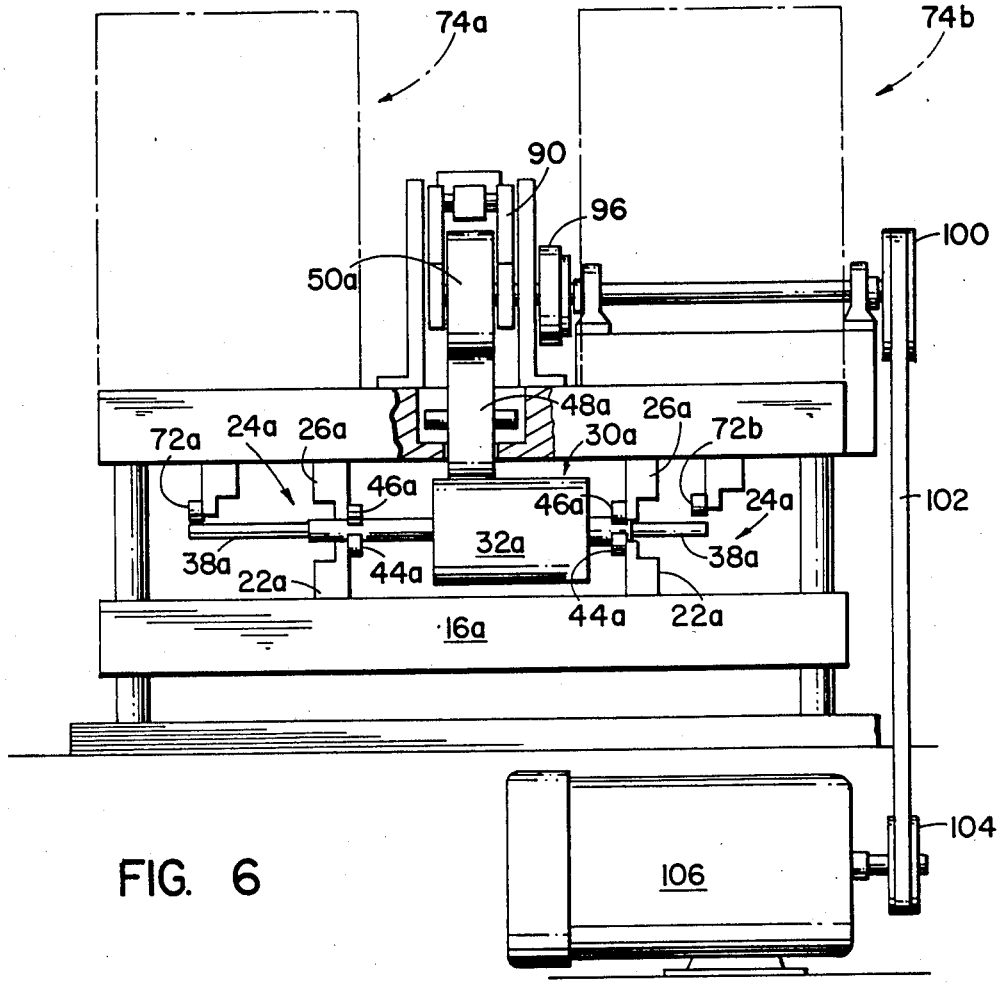
FIG. 6 is a front view of a second embodiment of the straightening machine wherein both projecting end sections of the workpiece may be straightened simultaneously.

Referring now to FIGS. 6 and 7, it will be observed that a second form of the straightening machine of the present invention shown therein may be substantially identical with the above described straightening machine except for the provision of first and second air over oil actuating systems **74*a* and 74*b* and first and second deflection devices comprising rollers 72*a*, 72*a* and 72*b*,72*b*. A workpiece 30*a* having intermediate section 32*a* is thus held in bearing units 24*a*,24*a* and is rotated by a drive roller 48*a*. Air over oil actuators 74*a* and 74*b* can thus urge the small deflection rollers 72*a*,72*b* simultaneously downwardly whereby to first deflect and thereafter permit the gradual and closely controlled return movement of opposite end sections 38*a*,38*a* of the workpiece. When the end portions 38*a*,38*a* have moved upwardly to positions of axial alignment with the remaining sections of the workpiece 30*a*** both end portions or armature shafts are in an efficiently straightened condition.

It should also be noted in FIG. 7 that a slightly different drive means for the drive roller 48 is provided. Thus, fluid operable cylinder 86 is pivotally connected at 88 with drive roll **50*a* support member 90. The support member 90 is in turn pivotally mounted at 92 so as to swing the drive roll 50*a* upwardly and downwardly in an arcuate manner as indicated at 94 for engaging and disengaging the rollers 50*a* and 48*a* as required. The driving connection for the roller 50*a* may be provided through a pulley 96, drive belt 98, pulley 100**, drive belt 102, pulley 104, and an electric drive motor or the like at 106.

Figure 8:
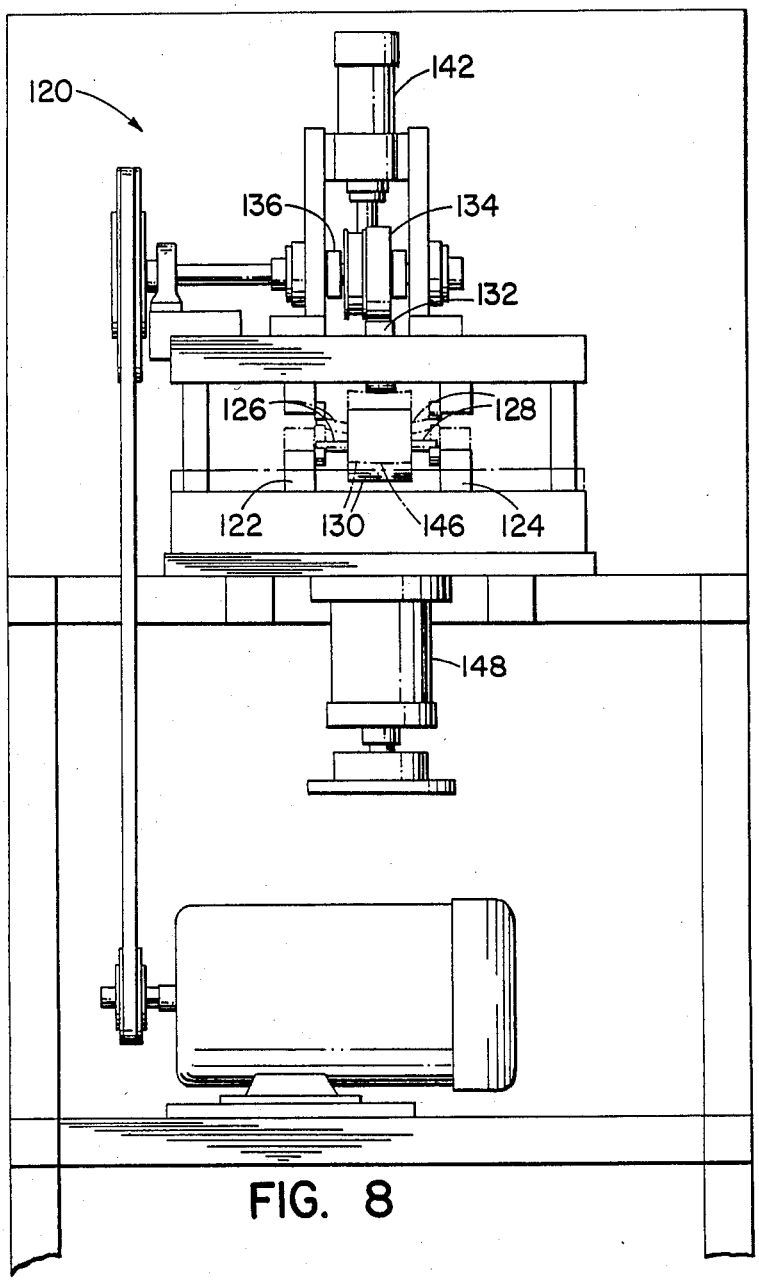
FIG. 8 is a partially schematic front view of a further embodiment of the straightening machine.
Figure 9:
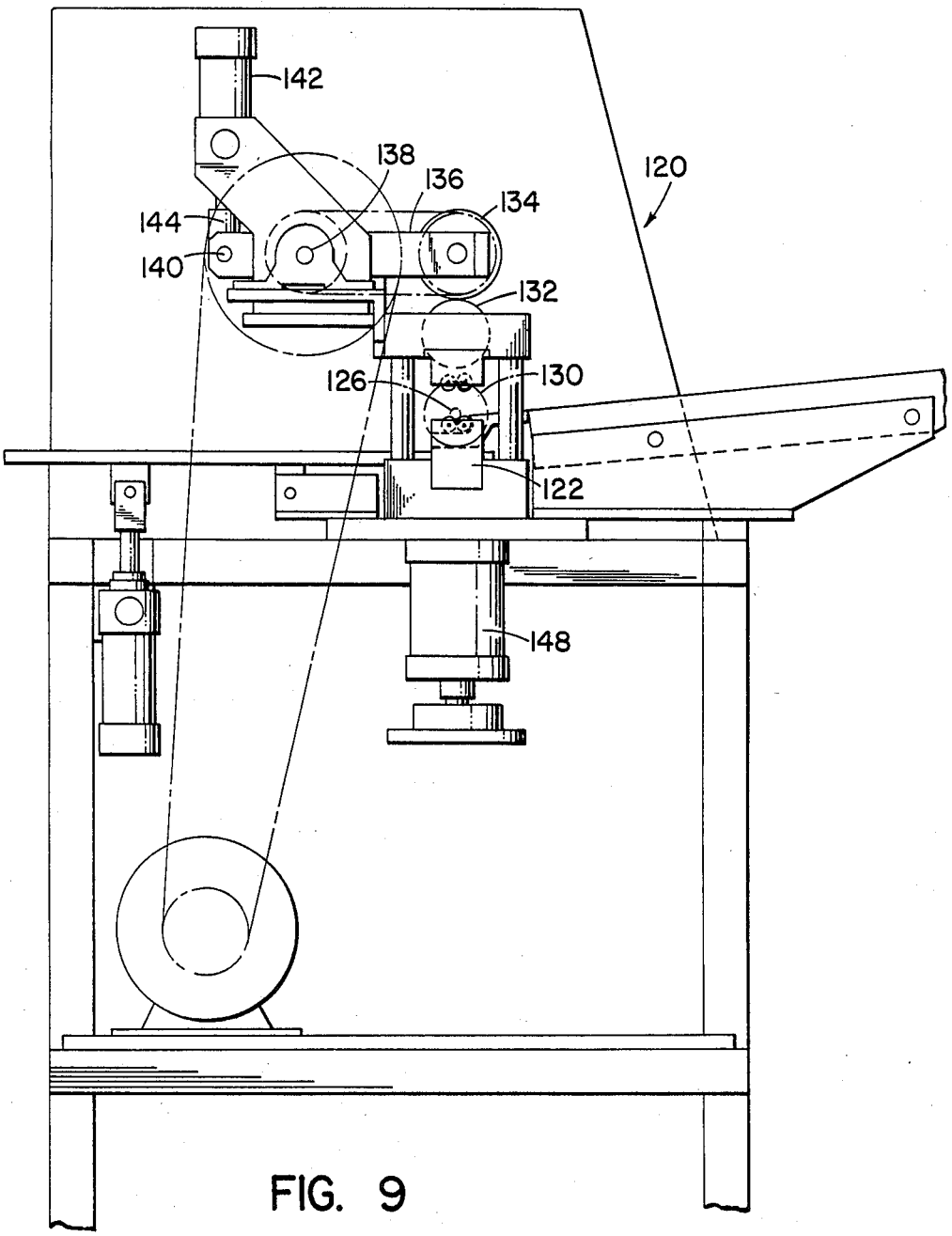
FIG. 9 is a partially schematic side view of the machine of FIG. 7.

Referring now to FIGS. 8 and 9, it will be observed that a straightening machine indicated generally at 120 is generally similar to the straightening machines described above. A pair of separable bearing units 122, 124 are provided for supporting opposite end sections 126, 128 of a workpiece having an intermediate section 130. A first drive roll 132 is mounted for floating engagement as in the case in the preceding drive rolls 48, 48*a* described above with a second drive roll 134 associated therewith. The drive roll 134 is swingable upwardly and downwardly as best illustrated in FIG. 9 for engagement with the roll 132.

As shown in Fig. 9, the roll 134 is mounted on the forwardly projecting end of an arm 136 pivoted at 138 and having a pivotal connection at 140 for movement arcuately up and down at the urging of a fluid cylinder 142 also connected via a drive rod 144 with a pivot 140.

As will be apparent, the second drive roll 134 can be urged downwardly in engagement with the first drive roll 132 whereby to rotate a workpiece such as the workpiece 126–130 and to deflect the intermediate section thereof downwardly as shown by broken line 146 in FIG. 8. The amount or degree of deflection of the intermediate section 130 may be controlled by limiting means associated with the fluid cylinder 142 or by similar means associated with a cylinder 148 similar to the cylinder above.

Further the rate of return of the intermediate section 130 to the position of axial alignment as required in an effective straightening operation can readily be controlled by means of a suitable flow control valve not shown but which may be associated with the fluid cylinder 142.

Straightening of the intermediate section 130 of the workpiece 126–130 relative to the end sections 126, 128 can be readily achieved with the FIG. 8, 9 embodiment and with other elements and devices within the machine operating in the manner set forth above for the FIG. 1–7 straightening machines.

As will be apparent from the foregoing, a specially adapted straightening machine has been provided for efficiently handling and straightening motor armature assemblies and the like in an automatic operation. That is, the armature assemblies may be deposited on loading rails, permitted to roll into the lower half sections of bearing units whereupon the machine can be operated automatically, as for example by a small micro-processor to sequentially straighten and discharge the assemblies. Obviously, if so desired, an automatic loading device can also be provided for depositing the armature assemblies on the loading rails in succession.

I claim:

1. A machine for straightening cylindrical workpieces having diametrically enlarged intermediate sections and reduced diameter opposite end sections coaxial with the intermediate sections; said machine comprising first and second bearing units aligned axially and spaced apart axially for engagement and support of said reduced diameter opposite end sections of a workpiece with at least one of said end sections projecting axially substantially beyond its associated bearing unit, said bearing units being radially separable for movement between open and closed positions for the radial introduction and retention of said workpiece end sections therein, power operated rotary drive means mounted for radial floating operation whereby to firmly engage said diametrically enlarged intermediate section of a workpiece held by said bearing units irrespective of slight variation in diameter and thus to positively rotate said workpiece during straightening thereof, and a radially movable deflection device engageable with said projecting end section of said workpiece during rotation thereof to bend the same out of axial alignment with the remaining sections of the workpiece and to return the same to a condition of axial alignment at a relatively slow and closely controlled rate of movement.

2. A straightening machine for cylindrical workpieces as set forth in claim 1 wherein both of said end sections of a workpiece retained by said bearing units project axially substantially beyond the bearing units, and wherein a second radially movable deflection device is provided and is engageable with the second projecting end section of the workpiece during rotation thereof to bend the same out of axial alignment with the remaining sections of the workpiece and thereafter to return the same to a condition of axial alignment at a relatively slow and closely controlled rate of movement.

3. A straightening machine for cylindrical workpieces as set forth in claim 1 wherein each of said bearing units has upper and lower half sections relatively movable vertically for the radial entry of the end sections of a workpiece and for the secure retention of said end sections in the bearing units.

4. A straightening machine for cylindrical workpieces as set forth in claim 3 wherein a support plate is provided with lower half sections of the bearing units mounted thereon and with the plate adapted for vertical movement to effect like movement of the bearing half sections, the upper bearing half sections being fixed vertically and the plate being movable whereby to urge the lower bearing half sections and a cylindrical workpiece held thereby upwardly into engagement between the workpiece end sections and the bearing upper half sections.

5. A straightening machine for cylindrical workpieces as set forth in claim 4 wherein said rotary drive means comprises a drive roll fixed above and between said lower half sections of the bearing unit so as to be engaged by the intermediate section of a workpiece with its end sections disposed in the bearing units and raised vertically on upward movement of the plate and the lower half sections of the bearing units.

6. A straightening machine for cylindrical workpieces as set forth in claim 5 wherein said drive roll has a relatively high friction surface for frictional driving engagement between the drive roll and the diametrically enlarged intermediate section of a workpiece held by the bearing units.

7. A straightening machine for cylindrical workpieces as set forth in claim 6 wherein the drive roll is mounted for floating operation in a vertical direction on engagement with a diametrically enlarged intermediate section of a workpiece, and wherein a second drive roll is provided and engageable with said first drive roll from above for rotating the same whereby to rotate a workpiece engaged by said first drive roll.

8. A straightening machine for cylindrical workpieces as set forth in claim 3 wherein said bearing half sections each comprise a pair of small radially spaced rollers on axes parallel with the axis of a workpiece disposed therein.

9. A straightening machine for cylindrical workpieces as set forth in claim 8 wherein said deflection device comprises a pair of radially spaced rollers on axes parallel with the axis of a workpiece held by said bearing units.

10. A straightening machine for cylindrical workpieces as set forth in claim 3 wherein said machine includes a pair of spaced loading rails inclined slightly downwardly from a position remote from the bearing units toward the bearing units and having discharge ends adjacent the bearing units, the remote end portions of said rails being adapted to receive the end sections of a workpiece with the workpiece rolling downwardly along the rails and into the open bearing units.

11. A straightening machine for cylindrical workpieces as set forth in claim 1 wherein a discharge device is provided for workpieces straightened in said machine, said discharge device comprising an intermittently operable member for engaging and removing cylindrical workpieces from the bearing units with the bearing units in an open condition subsequent to straightening of a workpiece.

12. A straightening machine for cylindrical workpieces as set forth in claim 11 wherein said discharge device comprises a narrow elongated member inclined slightly from the horizontal and adapted for the gravity discharge of a workpiece therealong, said member being pivotally mounted and operable intermittently as aforesaid to slightly lift a workpiece from the open bearing units whereupon the workpiece rolls along the member for discharge therefrom.

13. A machine for straightening cylindrical workpieces having diametrically enlarged intermediate sections and reduced diameter opposite end sections coaxial with the intermediate sections; said machine comprising first and second bearing units aligned axially but spaced apart axially for engagement and support of said reduced diameter opposite end sections of a workpiece, said bearing units being radially separable for movement between open and closed positions for the radial introduction and retention of said workpiece end sections therein, a first roll mounted for radial floating operation whereby to firmly engage said diametrically enlarged intermediate section of a workpiece held by said bearing units irrespective of slight variation in diameter and thus to positively rotate said workpiece during straightening thereof, a power operated second roll engageable with said first roll to frictionally drive the same and thereby to rotate the workpiece, and a means for urging said second roll toward said first roll and said enlarged intermediate workpiece section whereby to bend the same out of axial alignment with the remaining sections of the workpiece and to return the same to a condition of axial alignment at a relatively slow and closely controlled rate of movement.

14. A straightening machine for cylindrical workpieces as set forth in claim 13 wherein each of said bearing units has upper and lower half sections relatively movable vertically for the radial entry of the end sections of a workpiece and for the secure retention of said end sections in the bearing units.

15. A straightening machine for cylindrical workpieces as set forth in claim 13 wherein a support plate is provided with lower half sections of the bearing units mounted thereon and with the plate adapted for vertical movement to effect like movement of the bearing half sections, the upper bearing half sections being fixed vertically and the plate being movable whereby to urge the lower bearing half sections and a cylindrical workpiece held thereby upwardly into engagement between the workpiece end sections and the bearing upper half sections.

16. A straightening machine for cylindrical workpieces as set forth in claim 13 wherein a discharge device is provided for workpieces straightened in said machine, said discharge device comprising an intermittently operable member for engaging and removing cylindrical workpieces from the bearing units with the bearing units in an open condition subsequent to straightening of a workpiece.

17. A straightening machine for cylindrical workpieces as set forth in claim 16 wherein said discharge device comprises a narrow elongated member inclined slightly from the horizontal and adapted for the gravity discharge of a workpiece therealong, said member being pivotally mounted and operable intermittently as aforesaid to slightly lift a workpiece from the open bearing units whereupon the workpiece rolls along the member for discharge therefrom.

18. A straightening machine for cylindrical workpieces as set forth in claim 13 wherein said means for urging said second roll toward said first roll and said enlarged intermediate workpiece section includes a fluid cylinder and at least one associated flow control valve, the latter serving to control the rate of return of the workpiece intermediate section after bending of the same.

19. A straightening machine for cylindrical workpieces as set forth in claim 18 wherein a limiting means is provided controlling the magnitude of the bend imposed upon the intermediate workpiece section.

* * * * *